US005794410A

United States Patent [19]

Harper

[11] Patent Number: 5,794,410

[45] Date of Patent: Aug. 18, 1998

[54] METHOD AND APPARATUS FOR WRAPPING SPHERICAL OBJECTS

[76] Inventor: Robert I. Harper, Unit 5, Dominion Works, Bilston Road, Wolverhampton, West Midlands, WV2 2NH., Great Britain

[21] Appl. No.: 849,629

[22] PCT Filed: Dec. 4, 1995

[86] PCT No.: PCT/GB95/02819

§ 371 Date: Jun. 4, 1997

§ 102(e) Date: Jun. 4, 1997

[87] PCT Pub. No.: WO96/17774

PCT Pub. Date: Jun. 13, 1996

[30] Foreign Application Priority Data

Dec. 7, 1994 [GB] United Kingdom ..... 9424616

[51] Int. Cl.[6] ..... B65B 11/54

[52] U.S. Cl. ..... 53/463; 53/226; 53/227; 53/464

[58] Field of Search ..... 53/463, 464, 227, 53/226, 221, 222, 461, 417, 416, 138.1, 370

[56] References Cited

U.S. PATENT DOCUMENTS

| | | | |
|---|---|---|---|
| 1,424,363 | 8/1922 | Levmann | 53/227 X |
| 2,009,241 | 7/1935 | Roberts | 53/226 |
| 2,513,459 | 7/1950 | Dodge | 53/226 X |
| 2,838,897 | 6/1958 | Ponten et al. | 53/226 |
| 3,245,198 | 4/1966 | Schmied | 53/464 |
| 4,510,735 | 4/1985 | Cillario | 53/464 |
| 4,525,983 | 7/1985 | Libow | 53/463 |

*Primary Examiner*—James F. Coan
*Attorney, Agent, or Firm*—Melvin I. Stoltz

[57] ABSTRACT

A method of wrapping generally spherical objects (16), for example, lettuces, includes placing a thermoplastic film on a work surface (14) which includes a downwardly movable support member (17) on to which the object (16) is placed. A displacement member (21) is then moved into engagement with the object (16) so as to displace the object (16) and the film downwardly through the central opening of an iris diaphragm (20). After the displacement member (21) has moved a predetermined distance downwardly, it is retracted upwardly and the iris diaphragm (20) is then closed. The object (16) is then rotated to gather the film around it. The displacement member (21) also comprises a heater head (22) which is then moved downwardly to contact the portions of the film projecting upwardly through the diaphragm (20) to fuse them together.

6 Claims, 7 Drawing Sheets

PC2

13
21
22
16
18
20
14
26
17
25
19
23
24
11
15
10
12

METHOD AND APPARATUS FOR WRAPPING SPHERICAL OBJECTS

FIELD OF THE INVENTION

This invention relates to a method of wrapping substantially spherical objects and to an apparatus for carrying out said method. The term "substantially spherical" is to be interpreted broadly so as to cover, for example, hemispherical objects or objects which, though generally round, are of an irregular configuration.

BACKGROUND TO THE INVENTION

With the increase in demand for fresh fruit and vegetables and the increases in the volumes of fruit and vegetables which are transported, often over large distances, there are requirements for wrapping such fruit and vegetables for transport in such way that, when they arrive at, for example, a supermarket, they are in good condition and ready for display.

The present invention has been developed specifically in relation to the wrapping of lettuces. A number of proposals have been made for wrapping lettuces in transparent plastic film but the methods currently in use are labour intensive and slow.

An earlier machine designed specifically for wrapping lettuces is disclosed in European Patent Specification No. 0 199 995. The method of wrapping performed by this machine included:

a) placing a thermoplastic film on a work surface which includes a support member movable downwardly relative to the remainder of the work surface, b) placing the object to be wrapped on the portion of the film resting on the support member, c) moving the support member and thus the object downwardly, d) rotating the lowered support member and object so as to cause the film to be twisted around the object, and e) moving a hot plate into contact with that portion of the film on top of the object so as to effect fusion and thus sealing of the film.

Although the machine shown in European Patent Specification was produced and promoted extensively, it was not successful. One reason for this may be that the method of operation of the machine was relatively slow. Another may be that the machine could not effectively wrap objects of different sizes. Thus, with the size and shape variations which are inevitable with natural produce such as lettuces, uneven wrapping was obtained.

It is accordingly an object of a first aspect of the present invention to provide an improved method of wrapping which is applicable to the wrapping of lettuces and other generally spherical vegetables or fruit or other objects which are of sufficient size that they can economically be wrapped individually, which method can be carried out at an economic rate and which adjusts automatically for variations in the sizes of the objects to be wrapped.

It is an object of a second aspect of the present invention to provide an improved apparatus for carrying out this method.

SUMMARY OF THE INVENTION

According to a first aspect of the present invention there is provided a method of wrapping a generally spherical object, which method comprises:

a) placing a thermoplastic film on a work surface which includes a support member movable downwardly relative to the remainder of the work surface, b) placing the object to be wrapped on the portion of the film resting on the support member, c) providing a displacement member which is movable into engagement with the uppermost portion of the object, d) moving said displacement member and thus the object and the support member downwardly until the displacement member has reached a predetermined position and the uppermost portion of the object is below the level of the work surface, e) maintaining the object and the support member in their downwardly displaced positions while moving the displacement member upwardly out of engagement with the object, f) operating gathering means which engages the thermoplastic film in such manner that the thermoplastic film is gathered around the object, g) effecting rotation of the support member and the object while the thermoplastic film is engaged by the gathering means, and h) effecting sealing of the uppermost portion of the film by moving the displacement member, which then acts as a heating element, into engagement with said uppermost portion of the film.

According to a second aspect of the present invention there is provided apparatus for wrapping generally spherical objects, which apparatus includes:

a) a work surface formed with an opening in which a support member can be located, b) means mounting the support member in such manner that it can be moved downwardly below the level of the work surface, c) means for placing a thermoplastic film an said work surface over said support member, d) means whereby an object to be wrapped can be placed on top of the thermoplastic film on the support member, e) a displacement member movable into engagement with the uppermost portion of the object to be wrapped, f) means for moving the displacement member initially downwardly into engagement with the object so that the object and the support member are displaced downwardly below the level of the work surface and then upwardly out of engagement with the object, g) gathering means arranged to engage the thermoplastic film when the object and the support member have been displaced downwardly and the displacement member has thereafter been moved upwardly, h) means for effecting rotation of the support member and thus the object when the support member and the object are in their downwardly displaced positions to wrap the thermoplastic film around the object, and i) means for effecting sealing of the uppermost portion of the film when wrapped around the object, characterised in that:

the means for moving the displacement member downwardly is such that, regardless of the size of the object, the displacement member is moved downwardly into the same position below the level of the work surface, and that the displacement member is in the form of or includes a heating element so that the displacement and sealing functions are performed by a single component.

As the displacement member/heating element is arranged so that it travels downwardly into a predetermined position, the distance travelled downwardly by the support member is dependent on the size of the object, which is interposed between the displacement member/heating element and the support member. Thus, when the support member and the object are rotated, the uppermost portion of the object will be at a constant height. In practice, the uppermost portion of the object will be located just beneath the gathering means.

The displacement member/heating element initially moves downwardly to displace the object and the support member until the displacement member/heating element reaches its predetermined position whereupon it moves upwardly clear of the object to allow operation of the gathering means to gather the thermoplastic film around the object as it is being rotated. The displacement member/heating element then moves downwardly again to engage the uppermost portion of the gathered film to effect fusion of the film and to seal the wrapping around the object.

The support member is preferably in the form of a bowl mounted on a stem extending vertically downwardly from the bowl so as to pass through a drive gear arranged to transmit drive to the stem so as to effect rotation of the stem and bowl about the vertical axis of the stem. The bowl may be of generally octagonal form in plan view so as to ensure that, when the bowl is rotated about the vertical axis of the stem, the object being wrapped is also rotated.

The lower port of the stem moves downwardly a distance dependent on the size of the object to be wrapped and latching means are preferably provided, operative when the displacement member reaches the lower limit of its travel, to hold the stem in this vertical position while rotation of the support bowl and the object to be wrapped is being carried out.

The gathering means is preferably in the form of an iris diaphragm located almost flush with the level of the work surface, the individual elements being movable into and out of retracted positions in which they are clear of the path of movement of the support member and the displacement member. Control means are preferably provided to effect movement of the iris elements inwardly out of their retracted positions when the displacement member/heating element has been moved upwardly clear of the displaced object. Said control means preferably also serves to effect return movement of the iris elements into their retracted positions at the appropriate stage in the operating cycle of the apparatus.

The displacement member/heating element is preferably in the form of an aluminium or copper heater head which may have a concave undersurface which is coated with a material having a low coefficient of sliding friction with the thermoplastic film and no tendency to adhere to the thermoplastic film while it is being melted. The preferred coating material is p.t.f.e., i.e. polytetrafluoroethylene. The heater head is preferably maintained at a temperature of the order of 190° C.

The film in which each object is wrapped is preferably fed from a roll by means of a transfer frame which is arranged for reciprocal movement over the work surface in per se known manner such that, at the end of a cycle of operations, a predetermined length of film is fed from the roll. The frame preferably includes a plurality of suction devices and the apparatus control system is preferably such that, when the part of the frame in which the suction devices are mounted is moved over the work surface and the previously advanced length of film, the suction devices are not actuated whereas, when the frame is moved from the operative position to the loading position, the suction devices are actuated and the film is advanced during such movement of the frame.

The piece of film in which each object is wrapped may be of octagonal form in plan so that, as the object is wrapped, the amount of spare film at the corners of the piece of film being wrapped around the object is kept to a minimum.

After the length of film has been advanced over the work surface, the piece of film resting on the work surface is cut from the remainder of the roll by means of a heated wire which is raised to contact the film and effect a severing operation.

The heated wire preferably comprises a central stem which extends about half the width of the work surface and a pair of V formations extending outwardly from either end of the stem. The portions of the film between the two arms of each V pass to a waste station.

When the object has been placed on the bowl, a first pneumatic piston and cylinder mechanism which controls downward movement of the displacement member/heating element is activated and a second pneumatic piston and cylinder mechanism which had been actuated to raise the bowl is connected to exhaust via a restriction. Thus, as the object is moved downwardly by the displacement member/heating element, the film will be caused to move downwardly with the object and the piston of the second piston and cylinder mechanism is moved downwardly against the back pressure afforded by the restriction.

If the objects to be wrapped are relatively heavy objects, spring means may also be provided to assist in restraining downward movement of the piston of the second piston and cylinder mechanism and to assist upward movement thereof.

The roll on which the film is supported is preferably located at one end of the apparatus and may be fed from the roll by feeding means which includes a static eliminator and a dancer bar.

After the object has been wrapped and the heating element has effected melting of the upwardly presented portion of the film, the wrapped object is preferably displaced from the bowl on to a belt conveyor leading to a discharge or delivery point.

The wrapped object may alternatively be displaced into a discharge chute which may, in turn, lead to a belt conveyor.

As explained above, the apparatus has been developed initially in relation to the wrapping of lettuces and, when the lettuce is initially loaded on to the apparatus, it will be placed with its butt directed upwardly so that the heating element, when it moves downwardly to displace the bowl and the lettuce, will not engage the leaves of the lettuce. Also, when the lettuce is rotated during wrapping and melting of the film, the butt will be uppermost so that the fused plastic material which is thus formed will be in line with the butt of the lettuce, thus enabling the wrapped lettuce to be displayed in an attractive manner in a supermarket or the like.

Other generally spherical objects which can be wrapped include whole and half cabbages, savoys and melons, but these are examples only.

DESCRIPTION OF THE PERFERRED EMBODIMENT

Figure 1:
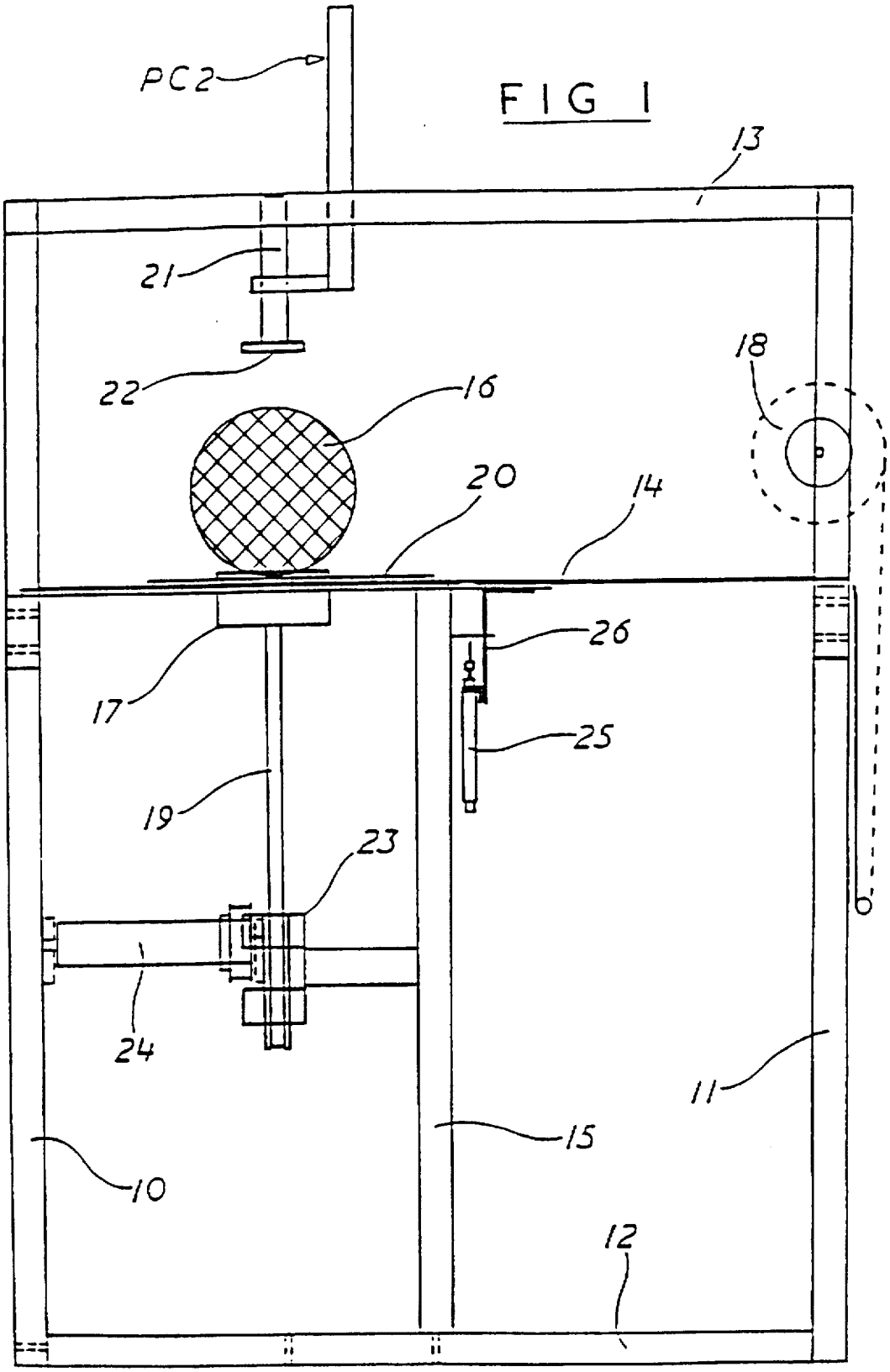
FIGS. 1 to 6 show different stages in the wrapping of a lettuce.
Figure 2:
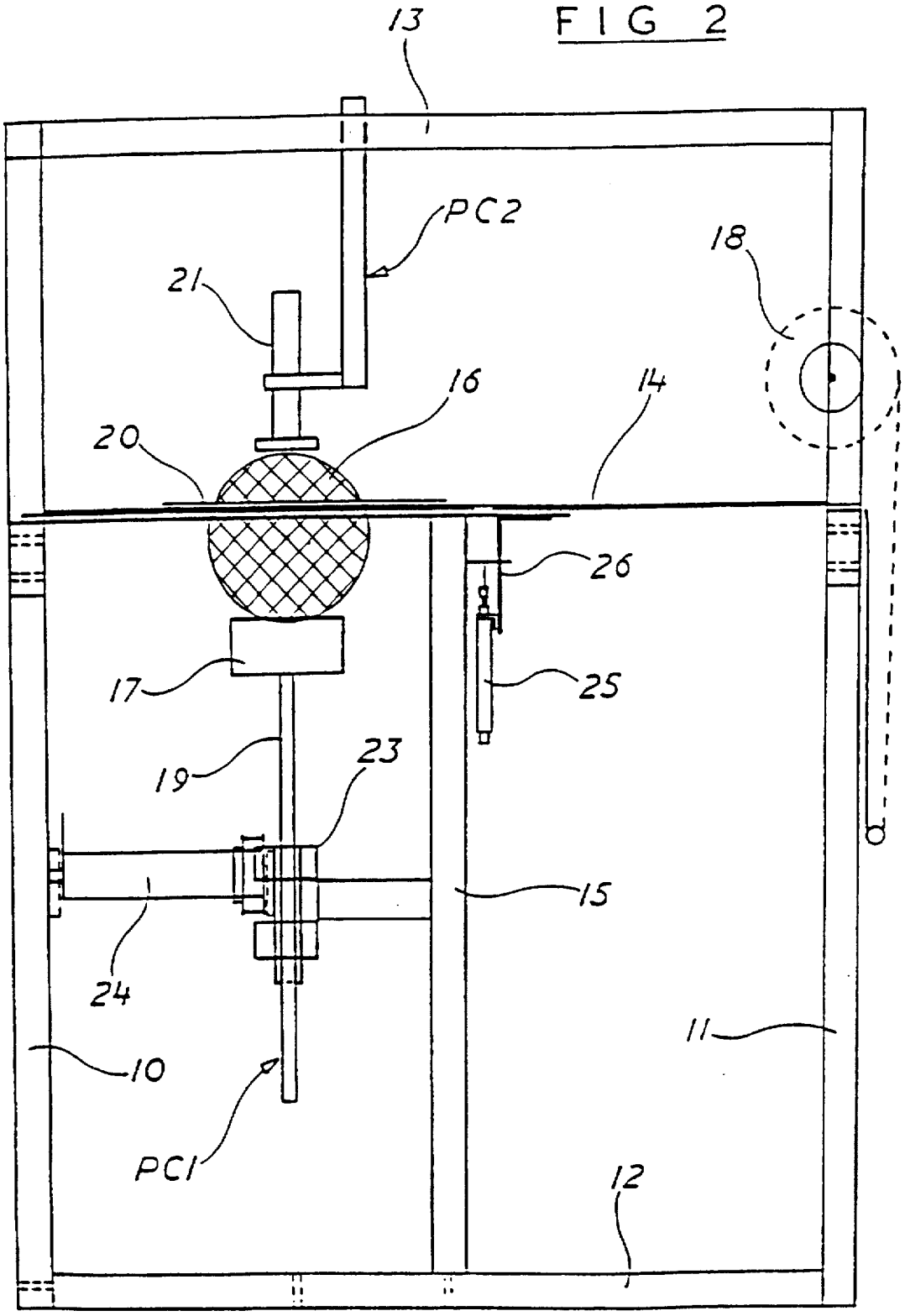

The apparatus shown in FIGS. 1 to 6 comprises a frame which is of rectangular form in plan view and includes front and rear upright members 10 and 11, a base 12 and a top 13. The frame can be provided with castor wheels (not shown) at its four corners to facilitate movement of the apparatus.

There is a work surface 14 at a position corresponding to two thirds of the height of the frame and intermediate frame members 15 to support the central part of the work surface 14. The front of the frame includes an access opening through which an object 16 to be wrapped can be placed on the work surface 14. Such placing of the object 16 can be effected manually or, if desired, an automatic feed mechanism (not shown) can be provided. The object 16 is typically a lettuce, but other vegetables and fruit can also be wrapped, for example, cauliflowers or halves of melons. If the object to be wrapped is a lettuce, it will be placed in position with its butt uppermost.

The part of the work surface 14 on which the object 14 is placed includes an opening through which, in the loading position shown in FIG. 1, the uppermost portion of a support bowl or holder 17 is arranged to project. Before the object 16 is placed on position, a sheet of thermoplastic film is drawn from a roll 18 over the work surface 14 and the object 16 is thus placed on the bowl or holder 17 on top of the film resting on the holder.

Figure 6:
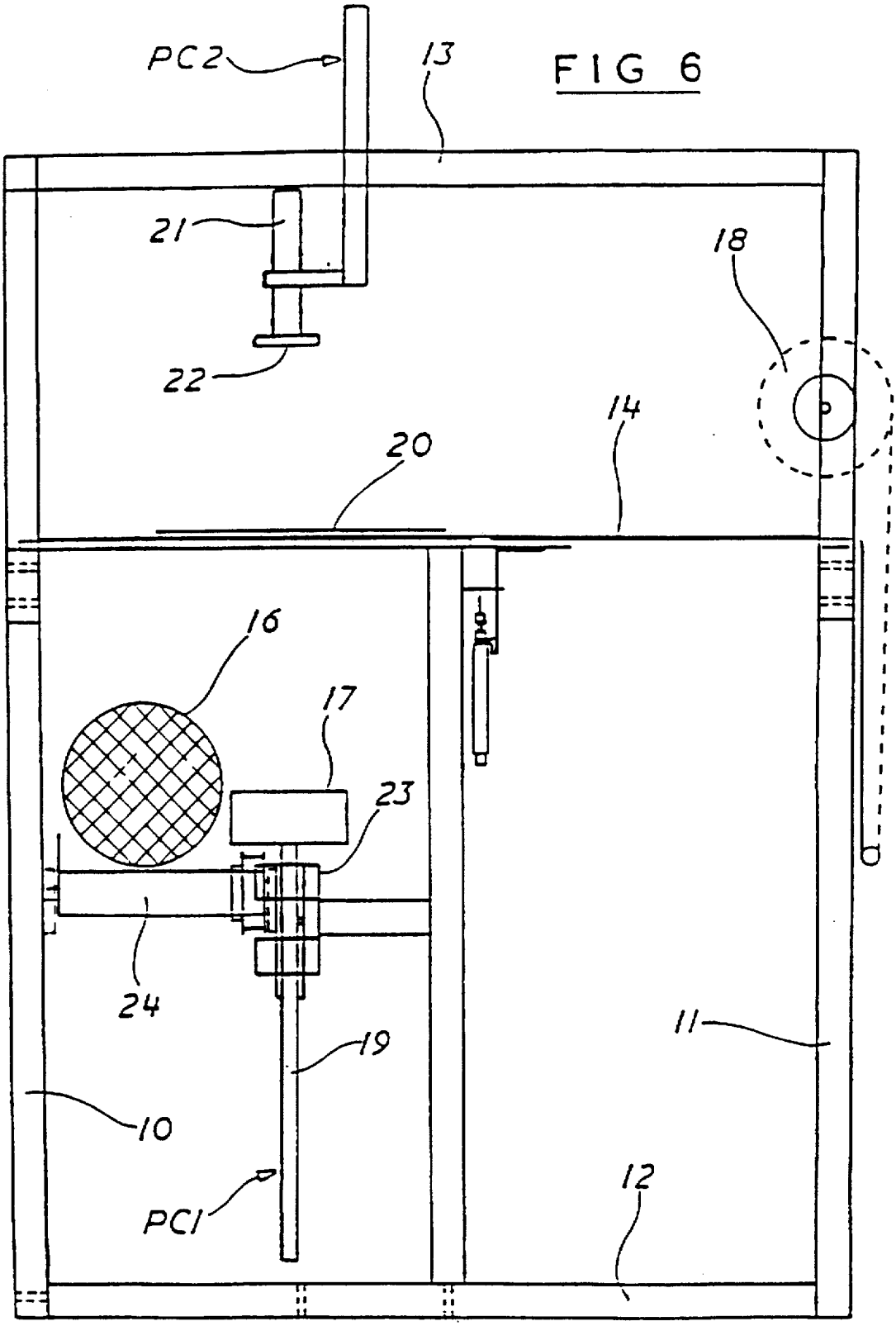

The holder 17 is mounted at the upper end of a vertical stem 19 which is coupled by means of a bearing arrangement to the piston of a pneumatic piston and cylinder mechanism PC1 which is operable to move the holder 17 upwardly from a downwardly displaced position, as shown in FIG. 6, into the loading position shown in FIG. 1. The stem 19 is thus movable vertically with the piston of mechanism PC1 but is rotatable relative to the piston about the axis of the stem 19.

The work surface 14 also includes an iris diaphragm 20 which is mounted immediately below the level of the work surface and operates in a horizontal plane. The individual elements of the iris diaphragm 20 are initially in their retracted positions so that the holder 17 can project upwardly through the central opening of the diaphragm 20.

A sealing member 21 is located above the work surface 14 and has its axis of movement coincident with the axis of movement of the vertical stem 19 and thus coincident with the centre of the opening afforded by the iris diaphragm 20. The sealing member 21 includes an aluminium or copper heater head 22 having a concave undersurface which is maintained at a substantially constant temperature of the order of 190° C. The undersurface of the heater head 22 is coated with p.t.f.e. so that, when it is moved into contact with either the object 16 or the film wrapped around the object, the head 22 will have a low coefficient of sliding friction with the object 16 or the film and the film will not tend to adhere to the head 22.

Upward and downward movement of the sealing member 21 is effected by means of a second pneumatic piston and cylinder mechanism PC2 and the whole sequence of operations of the apparatus is controlled by a programme controller (not shown).

At the commencement of a cycle of operations, the apparatus is in the condition shown in FIG. 1. A sheet of film has been fed from the roll 18 and is resting on top of the holder 17. A lettuce or other object 16 has been placed on the holder 17 on top of the film. The iris diaphragm 20 is open and the sealing member 21 is in its uppermost position.

After the lettuce or other object 16 has been placed in position, the operator may press a "start" button (not shown) or other means may be provided for initiating a cycle of operations. The sealing member 21 will now be moved downwardly by the operation of the piston and cylinder mechanism PC2 until the concave undersurface of the head 22 engages the butt of the lettuce 16 (or the uppermost part of any other object). Continued downward movement of the sealing member 21 under the operation of the piston and cylinder mechanism PC2 then causes the holder 17 and stem 19 to be moved downwardly with the lettuce or other object 16 serving to transmit the pressure applied by the head 22 to be transmitted to the holder 17. As the lettuce or other object 16 is moved downwardly, the sheet of film will also be drawn downwardly.

During such downward movement of the sealing member 21, the lettuce or other object 16 and the holder 17, the cylinder of the first piston and cylinder mechanism PC1 is connected to exhaust via a restrictor which provides, in effect, a back pressure against which the piston of piston and cylinder mechanism PC1 is displaced. This resistance to movement will, in addition, provide a resistance to movement of piston and cylinder mechanism PC2 and the controls for piston and cylinder mechanism PC2 will accordingly include a sensor such that, if no resistance is sensed after a predetermined travel of the piston of piston and cylinder mechanism PC2, downward travel of the piston of mechanism PC2 will be terminated and the piston of mechanism PC2 will be returned to its starting position. If, therefore, a cycle of operations is initiated when there is no lettuce or other object 16 in position waiting to be wrapped, only limited travel of the piston of mechanism PC2 will be effected and the piston will then return to its starting position.

If the objects to be wrapped are relatively heavy, for example, if they are cabbages as opposed to lettuces, the resistance to downward movement of the piston of piston and cylinder mechanism will be assisted by means of a spring arranged to act in a vertical direction, i.e. so as to resist downward movement of the piston of mechanism PC1 but to assist upward movement thereof.

Figure 3:
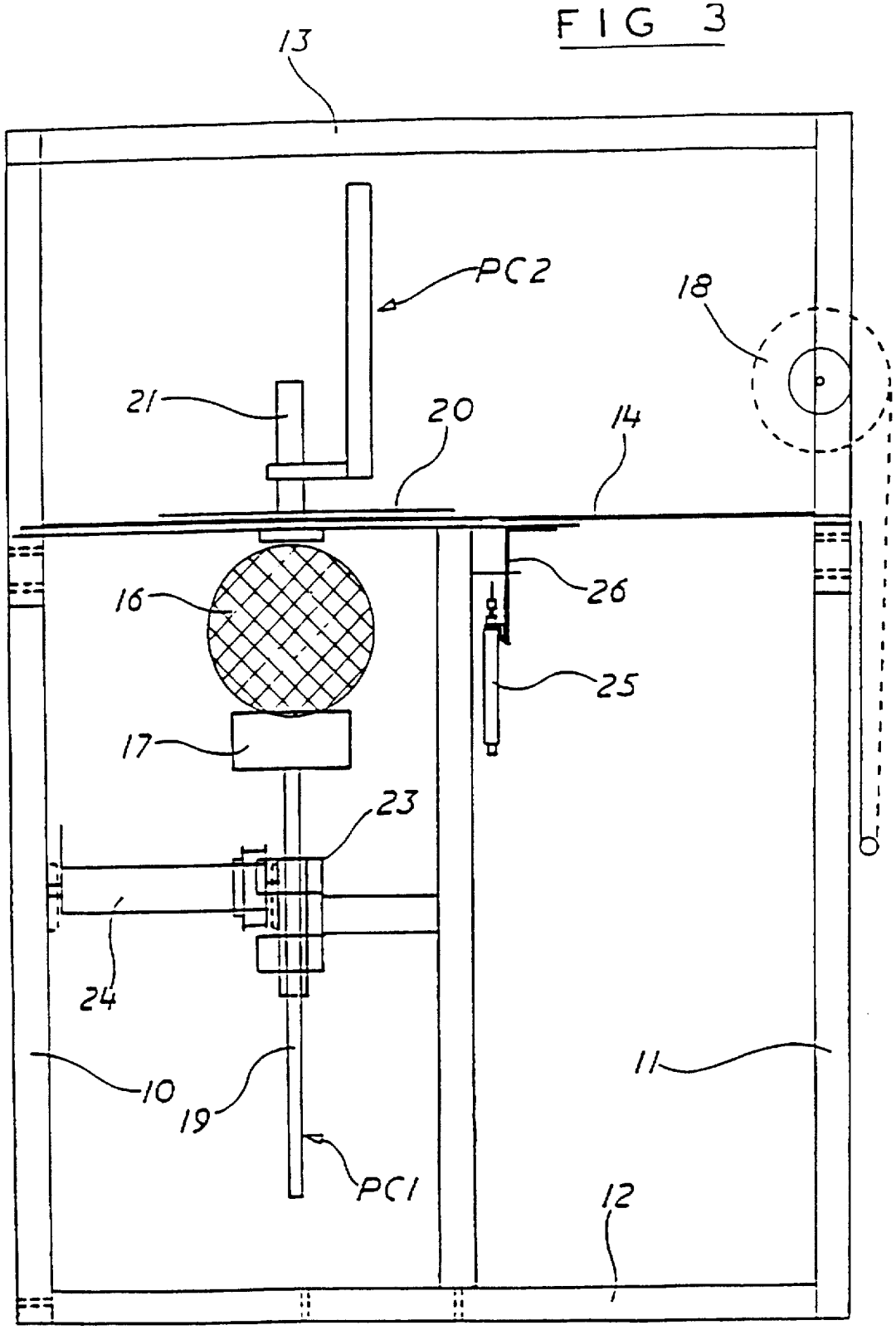

Assuming that there is a lettuce or other object 16 in position waiting to be wrapped, downward movement of the sealing member 21 will continue until the position shown in FIG. 3 is reached. The piston of piston and cylinder mechanism PC2 is at the end of its stroke; the undersurface of the head 22 is below the level of the iris diaphragm 20; the whole of the lettuce or other object 16 is also below the level of the iris diaphragm 20 and the sheet of film on which the lettuce or other object 16 is resting has been drawn partially through the opening in the work surface 14.

Once this end of stroke position has been reached, a signal is sent to the piston and cylinder mechanism PC1 and the piston of mechanism PC1 is latched or held in the position into which it has then been moved. Such latching or holding can be achieved by the arrangement shown in FIGS. 7A and 7B, as described in detail below. A condition is thus obtained in which the holder 17 has been moved downwardly by a distance which depends on the size of the lettuce or other object 16 resting on the holder 17. If a large lettuce is being wrapped, the holder 17 will have been moved downwardly through a greater distance than if a smaller lettuce is being wrapped. In any event, once the holder 17 has been displaced downwardly, it and the object 16 resting on it will be held against further downward movement.

Figure 4:
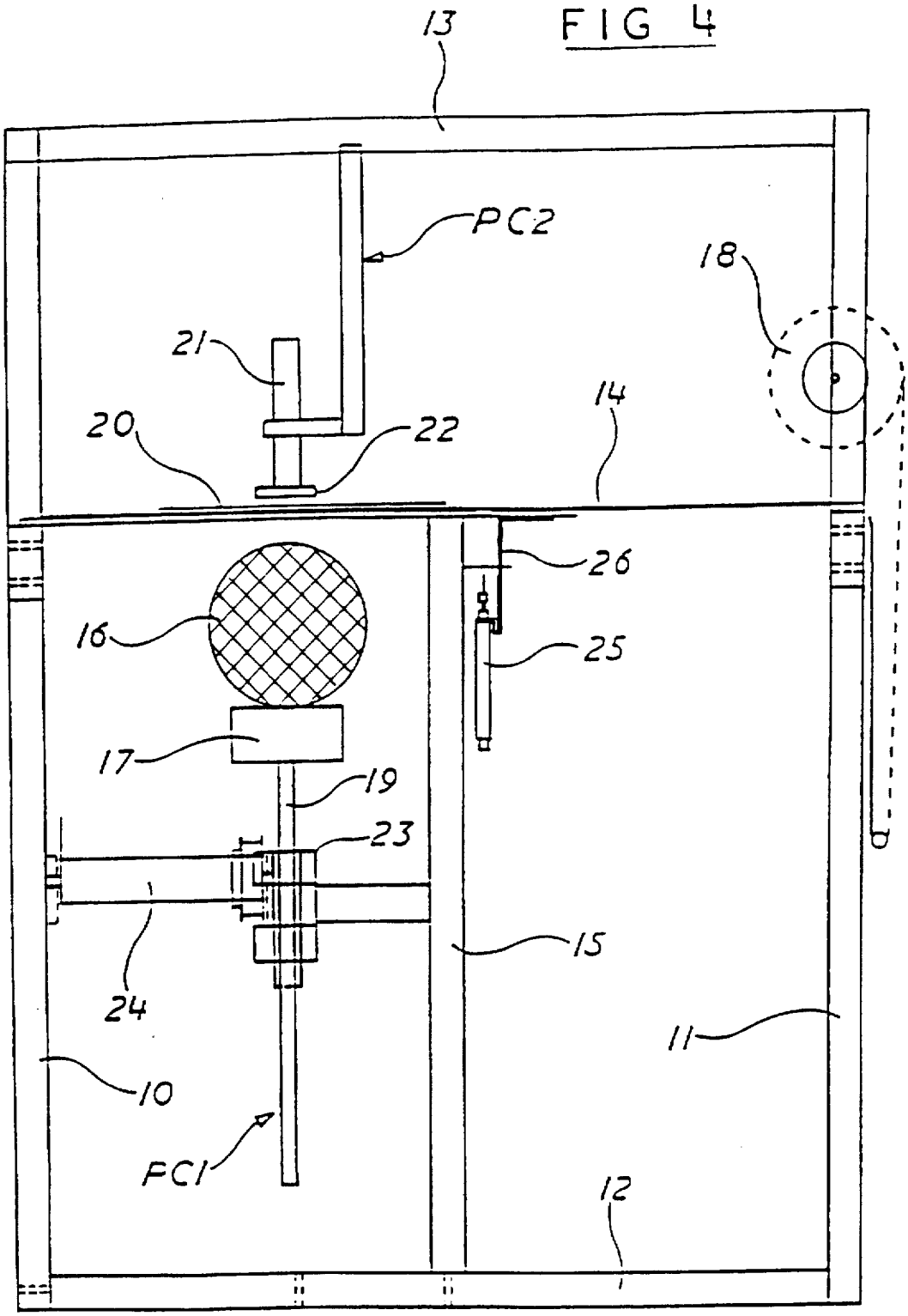

After the piston of piston and cylinder mechanism PC2 has completed its downward stroke, it will be moved upwardly to move the sealing member 21 from the position shown in FIG. 3 into the position shown in FIG. 4 in which the lower surface of the head 22 is clear of the iris diaphragm 20. The edge portions of the sheet of film will not have passed downwardly through the opening in the work surface 14 and the iris diaphragm 20 is then closed gathering the edge portions of the film together.

Once the iris diaphragm 20 has been closed, a rotary drive mechanism 23 is actuated to effect rotation of the stem 19, the holder 17 and the object 16 resting on the holder 17. To ensure that the lettuce or other object 16 rotates with the holder 17, the holder 17 is in the form of a non-circular bowl, for example, a bowl of octagonal form in plan may be used. As the holder 17 and the lettuce or other object 16 are rotated about the vertical axis of the stem 19, the sheet of film will be caused to become closely wrapped around the lettuce or other object 16. The closure of the iris diaphragm 20 effectively serves to gather together the edge portions of the sheet of film projecting above the level of the work surface so that the sheet of film is wrapped tightly around the lettuce or other object.

It is to be noted that the fact that the uppermost portion of the lettuce or other object 16 is always at the same height, and is positioned close to the undersurface of the iris diaphragm 20, facilitates such tight wrapping of the sheet of film. If the space between the uppermost portion of the lettuce and the undersurface of the iris diaphragm 20 depended on the size of the lettuce, smaller than average lettuces would, inevitably, be wrapped less tightly than larger lettuces.

Figure 5:
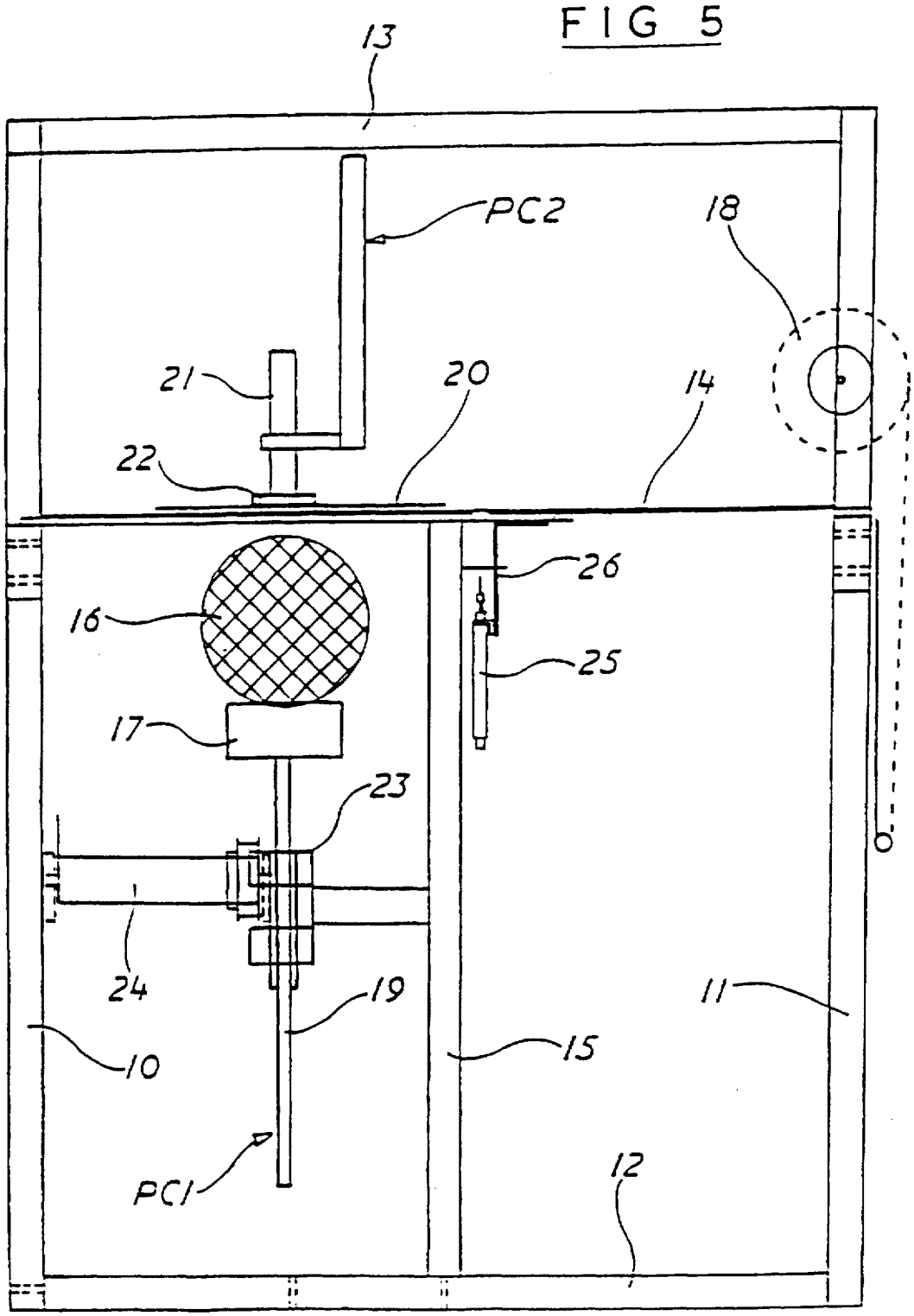

After the holder 17 and the lettuce or other object 16 have been rotated about the vertical axis of the stem 19 so as to obtain effective wrapping of the film around the lettuce or other object 16, the piston and cylinder mechanism PC2 will again be operated to move the sealing member 21 into the position shown in FIG. 5 in which it engages those portions of the thermoplastic film projecting upwardly through the centre of the closed iris diaphragm. Rotation of the holder 17 and lettuce or other object 16 under the action of the rotary drive mechanism 23 will be continued and, as the heated surface of the head 22 contacts the film, fusion of the film will be effected. The film will thus become fused together to seal and close the envelope within which the lettuce or other object 16 is now contained. If the object 16 to be wrapped is a lettuce, the butt of the lettuce is uppermost and the "button" formed by fusion of the plastic film will be in line with the butt of the lettuce so that, when the lettuce is displayed in a supermarket, the plastic "button" will not be unsightly and will not detract from the visual appeal of the wrapped lettuce.

Figure 7A:
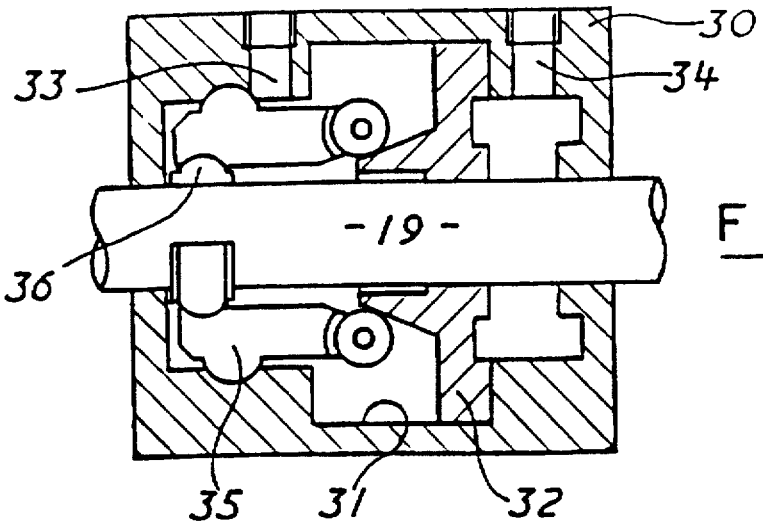
FIGS. 7A and 7B are detail views showing the provision of a latching mechanism for locking the piston of one of the piston and cylinder mechanisms of the apparatus in a desired position.
Figure 7B:
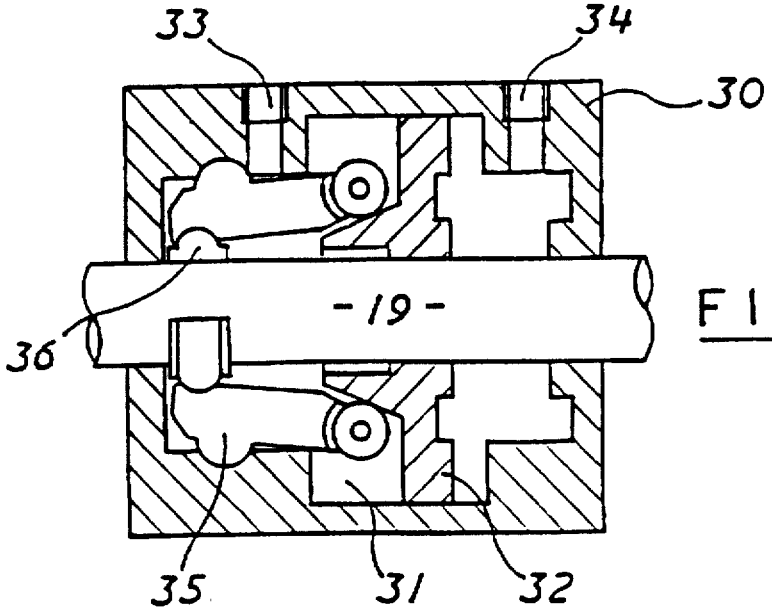

After the heated surface of the head 22 has remained in contact with the plastic film for a predetermined length of time, the piston and cylinder mechanism PC2 is again actuated to move the sealing member 21 and head 22 upwardly towards the initial position of FIG. 1. The shutter elements of the iris diaphragm 20 are opened to release any gripping action they were exerting on the fused portion of the plastic film and the locking or latching action exerted on the piston and cylinder mechanism PC1 by the arrangement shown in FIGS. 7A and 7B is released.

The holder 17, and with it the wrapped lettuce or other object 16, is then moved downwardly into the position shown in FIG. 6 and the wrapped lettuce or other object 16 is transferred to a discharge conveyor 24 by means of which the wrapped object is delivered to a packing position. Transfer of the wrapped lettuce 16 on to the conveyor 24 may be effected by means of a pneumatic piston and cylinder mechanism (not shown) which is arranged with its piston movable in a generally horizontal direction so as to engage a wrapped lettuce 16 and push it gently off the support member 17, i.e. to the left as viewed in FIG. 6. Once the piston has displaced the wrapped lettuce 16, it is withdrawn into its initial inoperative position.

As an alternative to providing a discharge conveyor, a discharge chute may be provided. The wrapped lettuce or other object 16 will then be pushed gently into the upper end of the discharge chute which may lead, in turn, to a belt conveyor by which the wrapped objects are delivered to the packing position.

Once the sealing member 21 and head 22 have been withdrawn upwardly and the iris diaphragm 20 has been opened, a new sheet of film is fed into position on the left-hand side of the work surface 14. This feed mechanism is similar to that described in European Patent Specification No. 0 199 995 and includes a generally horizontal frame (not shown) which is moved from an initial position, on the right-hand side of the work surface 14 (as viewed in the drawings) to a loading position on the left-hand side of the work surface 14.

The frame includes an array of apertures which are connected to a suction pump (not shown) so that the apertures function as suction devices when the pump is operating. The apparatus control system is such that, after upward movement of the sealing member 21, the pump is actuated so that the sheet of film then resting on the right-hand side of the work surface 14 is caused to adhere to the underside of the horizontal frame. The frame is then moved from its initial position (above the right-hand side of the work surface 14) to its loading position (above the left-hand side of the work surface 14). The pump is then switched off, to release the suction effect on the film, and the frame is returned to its initial position, above the right-hand side of work surface 14, leaving the sheet of film extending all the way over the work surface 14.

This is the condition which obtains at the end of a cycle of operations.

Figure 8:
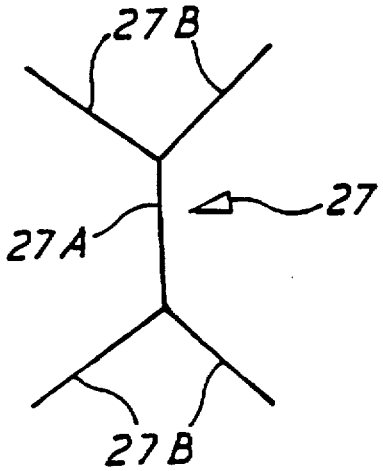
FIG. 8 is a plan view of a heating element used to sever a length of thermoplastic film from the roll from which it is fed.

The first step in a new cycle of operations is that a further pneumatic piston and cylinder mechanism 25 is actuated to effect upward movement of a bracket 26 which carries a heating element 27 shown, in plan view, in FIG. 8. As will be seen, the heating element 27 includes a central stem portion 27A and divergent or V-shaped end portions 27B including two limbs inclined at about 90° to one another. When the heating element 27 is moved into contact with the film, it causes the film to melt and, in effect, cuts off the portion on top of the left-hand side of the work surface 14 from the remainder of the roll.

The configuration of the heating element 27 is such, as can be seen from FIG. 8, that it will also cut off two triangular sections of the sheet of film, which will pass to waste, and the piece of film resting on the left-hand side of the work surface 14 will be of octagonal form. This octagonal configuration of the sheet of film ensures that, when the film is wrapped around the lettuce or other object 16, the surplus portions at the corners of the sheet of film are of the smallest possible size. The amount of film which is fused together to seal the wrapped lettuce or other object is thus minimised and the formation of unsightly flaps of unfused film is avoided.

Such upward and downward movement of the heating element 27 is effected during the initial travel of the sealing member 21 into engagement with the next lettuce or other object 16 so that, by the time that downward displacement of the lettuce or other object 16 is effected, that part of the film on the left-hand side of the work surface 14 has been severed from the remainder of the film on the roll 18.

Turning next to the arrangement shown in FIGS. 7A and 7B, this comprises a locking mechanism as produced by SMC Pneumatics, which acts to prevent or permit longitudinal movement of the stem 19. The mechanism includes a body 30 containing a cylindrical chamber 31 having an axis which coincides with that of the stem 19. The chamber 31 contains a displaceable member in the form of a brake piston 32 which is movable axially of the chamber 31. The chamber 31 has a pair of inlets 33 and 34. When the inlet 33 is connected to the air pressure supply and the inlet 34 is connected to exhaust, the brake piston 32 is moved into the position shown in FIG. 7A and, when the inlet 33 is connected to exhaust and the inlet 34 is connected to the air pressure supply, the brake piston 32 is moved into the position shown in FIG. 7B.

The brake piston 32 has a conical or tapered surface which engages rollers carried at the free ends of levers 35, which are pivotally mounted intermediate their ends in seatings in the wall of the chamber 31. The other ends of the levers 35 engage a brake shoe 36 which is arranged to engage the stem 19. Thus, in the condition shown in FIG. 7B, the brake piston 32 is moved towards the left-hand end of the chamber 31 and the brake shoe 36 is pressed into latching or locking engagement with the stem 19. On the other hand, when the air pressure supply is connected to inlet 33 and inlet 34 is connected to exhaust, the brake piston 32 is moved into the position shown in FIG. 7A and the locking action exerted on the stem 19 is released. The arrangement shown in FIGS. 7A and 7B thus provides a simple and effective means for holding the support member 17 in its downwardly displaced position as shown in FIG. 3.

The controls for the apparatus may be set so that a cycle of operations is completed in say three or four seconds and if, therefore, the apparatus is a dual apparatus with two mechanisms as described above arranged to operate side by side but sequentially so that a single operator can load lettuces on to the two mechanisms, an output of thirty or forty wrapped lettuces per minute can be obtained.

I claim:

1. A method of wrapping a generally spherical object (16), which method comprises:

a) placing a thermoplastic film on a work surface (14) which includes a support member (17) movable downwardly relative to the remainder of the work surface (14), b) placing the object (16) to be wrapped on the portion of the film resting on the support member (17);

c) providing a displacement member (21) which is movable into engagement with the uppermost portion of the object (16), d) moving said displacement member (21) and thus the object (16) and the support member (17) downwardly until the displacement member (21) has reached a predetermined position and the uppermost portion of the object (16) is below the level of the work surface (14), e) maintaining the object (16) and the support member (17) in their downwardly displaced positions while moving the displacement member (21) upwardly out of engagement with the object (16), f) operating gathering means (20) which engages the thermoplastic film in such manner that the thermoplastic film is gathered around the object (16), g) effecting rotation of the support member (17) and the object (16) while the thermoplastic film is engaged by the gathering means (20), and h) effecting sealing of the uppermost portion of the film by moving the displacement member (21), which then acts as a heating element (22), into engagement with said uppermost portion of the film.

2. Apparatus for wrapping generally spherical objects (16), which apparatus includes:

a) a work surface (14) formed with an opening in which a support member (17) can be located, b) means (PC1) mounting the support member (17) in such manner that it can be moved downwardly below the level of the work surface (14), c) means for placing a thermoplastic film on said work surface (14) over said support member (17), d) means whereby an object (16) to be wrapped can be placed on top of the thermoplastic film on the support member (17), e) a displacement member (21) movable into engagement with the uppermost portion of the object (16) to be wrapped, f) means (PC2) for moving the displacement member (21) initially downwardly into engagement with the object (16) so that the object (16) and the support member (17) are displaced downwardly below the level of the work surface (14) and then upwardly out of engagement with the object (16), g) gathering means (20) arranged to engage the thermoplastic film when the object (16) and the support member (17) have been displaced downwardly and the displacement member (21) has thereafter been moved upwardly, h) means (23) for effecting rotation of the support member (17) and thus the object (16) when the support member (17) and the object (16) are in their downwardly displaced positions to wrap the thermoplastic film around the object (16), and i) means (22) for effecting sealing of the uppermost portion of the film when wrapped around the object (16), charactersed in that:

the means (PC2) for moving the displacement member (21) downwardly is such that, regardless of the size of the object (16), the displacement member (21) is moved downwardly into the same position below the level of the work surface (14), and that the displacement member (21) is in the form of or includes a heating element (22) so that the displacement and sealing functions are performed by a single component.

3. Apparatus as claimed in claim 2, characterised in that the support member (17) is in the form of a bowl (17) mounted on a stem (19) extending vertically downwardly from the bowl (17) and that latching means are provided, operative when the displacement member (21) reaches the lower limit of its travel, to hold the stem (19) in this vertical position while rotation of the support bowl (17) and the object (16) to be wrapped is being carried out.

4. Apparatus as claimed in claim 2, characterised in that the displacement member/heating element (21, 22) includes a metal heater head (22) having an undersurface which is coated with a material having a low coefficient of sliding friction with the thermoplastic film.

5. Apparatus as claimed in claim 2, characterised by the provision of a first pneumatic piston and cylinder mechanism (PC2) which controls upward and downward movement of the displacement member/heating element (21, 22) and a second pneumatic piston and cylinder mechanism (PC1) which controls upward movement of the support member (17) and is connected to exhaust via a restriction.

6. Apparatus as claimed in claim 2, characterised in that the gathering means (20) is in the form of a per se known iris diaphragm (20) located substantially flush with the work surface (14).

* * * * *